United States Patent [19]

Guimond

[11] 3,941,389

[45] Mar. 2, 1976

[54] SPINNER GAME DEVICE

[76] Inventor: Charles W. Guimond, 1826 Norwood Drive, Grosse Pointe Woods, Mich. 48236

[22] Filed: May 30, 1975

[21] Appl. No.: 582,345

[52] U.S. Cl. ..... 273/142 HA; 35/74

[51] Int. Cl.[2] ..... A63F 5/04

[58] Field of Search..... 273/142 HA, 142 H, 142 R, 273/142 A, 142 B, 142 C, 142 D, 142 E, 142 F, 142 G, 142 J, 142 JA, 142 JB, 142 JC, 142 JD, 142 K, 143 R, 143 A, 143 B, 143 C, 143 D, 143 E; 46/65; 35/35 F, 74; 40/70 R, 70 A, 71, 113

[56] References Cited

UNITED STATES PATENTS

| | | | |
|---|---|---|---|
| 658,358 | 9/1900 | Ellis | 46/65 |
| 1,049,997 | 1/1913 | Coe | 35/74 |
| 1,617,831 | 2/1927 | Wolke | 273/142 HA X |
| 1,696,359 | 12/1928 | Nelson | 273/143 R |
| 1,892,664 | 1/1933 | Eyles | 273/142 HA |
| 2,138,821 | 12/1938 | Potter | 273/142 A |
| 2,565,557 | 8/1951 | Guimond | 273/142 HA |

FOREIGN PATENTS OR APPLICATIONS

| | | | |
|---|---|---|---|
| 369,285 | 2/1923 | Germany | 273/142 HA |
| 705,787 | 5/1941 | Germany | 273/143 E |
| 1,233,363 | 5/1971 | United Kingdom | 273/143 R |

*Primary Examiner*—Anton O. Oechsle
*Assistant Examiner*—Arnold W. Kramer
*Attorney, Agent, or Firm*—Burton and Parker

[57] ABSTRACT

A plurality of discs of progressively different radii are rotated about an upright post by a spinner member having a one-way driving connection with the discs. The discs are free to overrun the spinner member when the latter is slowed and stopped. The discs are also bodily movable as a group axially up and down the post; in their upper position the discs are brought into driving engagement with the spinner member and in their lower position the discs are freed from the spinner member but their rotation is snubbed and eventually halted by stop means. A control member is provided for bodily raising and lowering the discs as a group to enable the discs to be either rotated by the spinner member while in elevated position or braked to a stop while in lowered position. The discs carry different indicia on their exposed peripheral margins and designed to represent different games. The device includes a cover member which, depending on the game, has one or more radial slots in which aligned portions of the peripheral margins of the discs are exposed.

15 Claims, 9 Drawing Figures

SPINNER GAME DEVICE

BACKGROUND OF THE INVENTION

This invention relates to games and more particularly to a spinning game apparatus including a group of independently rotatable members carrying indicia means which, when the members are stopped, assume various combinations.

So far as applicant is aware, his own prior U.S. Pat. No. 2,565,557 for SPINNING DISK GAME APPARATUS is the closest prior art. The present invention is an improvement over that game apparatus in several important respects. In the device disclosed in applicant's aforesaid patent, the operator had to perform the compound motion of depressing the spinner member while at the same time spinning it to rotate the discs which was awkward for the operator. In another respect, the device illustrated in the aforesaid patent employed spring members for initially positioning the parts which were subject to metal fatigue and consequently their resiliency declined over a period of time.

SUMMARY OF THE INVENTION

Accordingly, an important object of the invention is to provide an improved spinning game device which overcomes certain disadvantages of similar game devices and which is composed of parts economical to construct and assemble and which is efficient in operation and durable in usage.

Another important object of the invention is to provide an improved spinning disc game device including a plurality of rotatable discs bearing circularly spaced indicia thereon which enables the player to apply simple manual motions to impart rotation to the discs and to cause the discs to come to a halt in upredictable combinations of registering indicia.

A further important object of the invention is to provide a spinning disc game device having improved means for stopping the rotation of the disc while concurrently permitting the discs to have limited freedom to move independently of one another as they come to a halt.

A further important object of the invention is to provide a spinning disc game device which is designed so that the base and disc spinning portions of the device are the same for several different games, leaving only the top or cover portion to be varied in manufacture to suit particular games.

In carrying out these and other objects, the present invention contemplates a spinning disc game device composed of parts which are economical to fabricate and assemble and which is designed for rugged handling. The basic parts of the device are so designed that they may be used for a number of different spinning disc games. These parts include a plurality of discs of progressively different radii arranged in a stack about an upright post for rotation thereabout and bearing indicia on their respective exposed peripheral margins. In addition to their rotation, the discs are bodily movable axially of the post by movement of a control member underlying the disc stack. In one direction of its movement the control member elevates the disc stack to a raised level where it assumes a one-way drive relationship with a spinner member and when moved in reverse direction the control members allow the disc stack to return to initial starting position. When raised to their upper level the discs, a one-way driving element carried by the spinner member is movable into registering apertures in the discs and will impart rotation to the discs when the spinner member is rotated in one direction. However, the driving element is retractable from the disc apertures when spinning effort is discontinued at which time the discs freely overrun the spinner member. When the control member is moved in the direction to cause the rotating discs to descend to their initial starting position, the discs are restrainingly slowed down individually by a stop provision to assume any one of a large combination of indicia aligned registrations.

Most games to which this invention is applicable require a provision for concealing much of the discs and the indicia or characters thereon and for this purpose a cover member is included in the herein illustrated embodiments of the invention. In one embodiment four radial slots are formed in the cover member located 90° apart from one another. Additionally, each slot is provided with an individual cover approximating the dimensions of the slot which is slidable outwardly of the slot to expose successively the indicia or characters on the discs registering with the slot. This enables the players associated with each slot to partially or wholly conceal the value of the indicia registering with their slot. In another form of the invention illustrated herein, the cover member is provided with a single slot and the players take turns using the device.

BRIEF DESCRIPTION OF THE DRAWING

Various other objects, advantages and meritorious features of this invention will appear more fully from the following specification, appended claims and accompanying drawing figures wherein:

DESCRIPTION OF PREFERRED EMBODIMENTS

Several embodiments of the invention are illustrated herein for the purpose of showing the use of the invention for several different games. However, an important feature of the invention is the use of a basic structure designed for playing these several games and others for which the invention is adaptable. This basic structure of the game device comprises a stationary base member 10, preferably circular as shown, and an upright shaft or post 12 centrally secured in any suitable manner to the base member and rising vertically thereabove. Rotatable about the post is a loose assembly of members preferably in the shape of discs 14 which are progressively of larger diameter from the top to the bottom so that their respective peripheral margins are visible to the eye when viewed from above. The discs 14 are also axially movable on the post 12 from a lower level position to an upper level position and return as will be explained in more detail hereinafter. Indicia means are carried on the exposed marginal portions of the discs which are representative of the symbols or characters for whatever game the device is intended.

Figure 4:
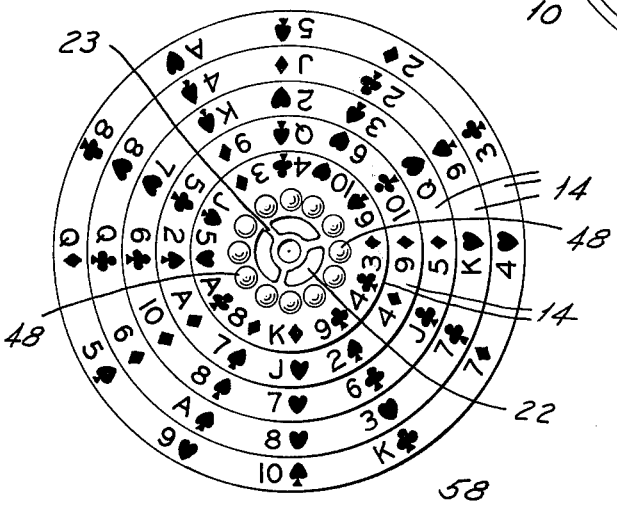
FIG. 4 is a top view of the disc stack alone showing the arrangement of the indicia on the exposed peripheral margins of the discs for playing a card game.
Figure 5:
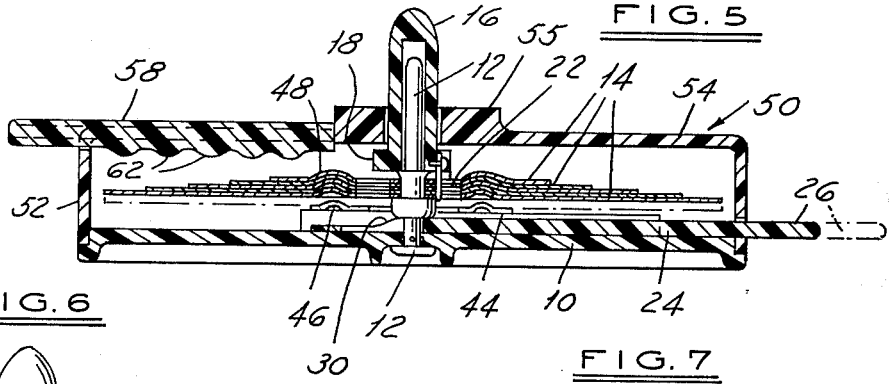
FIG. 5 is a cross sectional view of the embodiment of FIG. 1 taken along line 5—5 thereof.

A spinner control member or knob 16 for imparting rotation to the discs is telescopingly received on the upright post when initially assembled and is journaled for rotation therearound. Unlike applicant's patented device mentioned hereinabove, the knob 16 is not normally slidable for axial movement on the post in order to be drivingly coupled to the discs 14. Instead, when the group of discs 14 are raised to their upper level position, such as shown in FIG. 5, they are then capable of being drivingly coupled to the knob 16 for rotation in one direction about the post 12. However, the means for forming the one-way driving connection between knob and the discs 14 is herein shown as being similar to that disclosed in the aforementioned patent and particularly FIGS. 6 and 7 thereof. Such a one-way driving connection comprises a shoulder 18 on the lower end of the knob 16 which is recessed on one side to receive a depending driving pin 20 and which pin is pivotally mounted on the knob for swinging movements from a vertical position to a horizontal position as shown respectively by full and dotted lines in FIG. 6. At the same radial distance from the axis of the post 12 as the pivoted pin 20 each disc 14 is provided with a similar circular series of arcuate openings or slots 22 centered on the axis of the discs as shown in FIG. 4, but separated from one another by narrow bridging portions 23 which connect the central portion of each disc with the outer portions thereof. The slots 22 are both longer and wider than the diameter of the pin 20 to permit it to easily enter the apertures when the knob 16 is rotated in one direction. The result is the knob is drivingly connected to the assembly of discs for rotation in this single direction. It is evident, however, that if the knob is rotated in the reverse direction or the discs overrun the knob in the driving direction the pin will be raised by the edges of the slots 22 to the ineffective horizontal position shown in dotted outline in FIG. 6.

Figure 2:
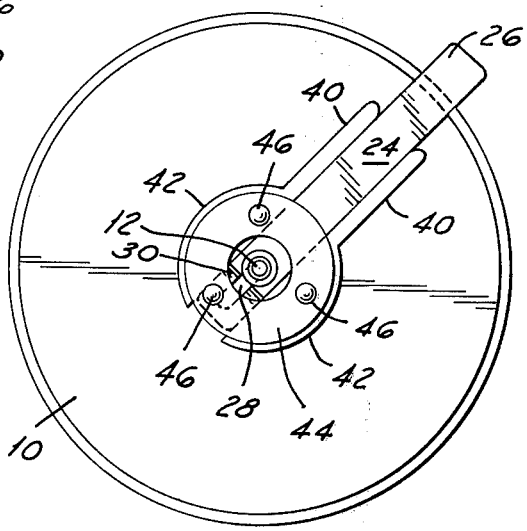
FIG. 2 is a top view of the base portion of the game device of FIG. 1 with the cover member, discs and spinner member removed.

Normally, the group of discs 14 assume, by virtue of gravity, the lowest position possible on the upright post 12. When in such position they are released from driving connection with the spinner knob 16. To raise them to the height for such driving connection a second control member is employed. A desirable type of implement for this purpose is illustrated in FIGS. 2 and 5 and takes the form of an elongated thin member 24 resting on the base support 10 and guided for limited to and fro motion in the direction of its longitudinal dimension. The outer end portion 26 of this control member extends beyond the base 10 in either of its two controlling positions as shown in FIG. 5 by the full and dotted positions of the end portion 26. The inner end portion of this second control member is longitudinally slotted as at 28 in FIG. 2 to straddle the upright post 12. Within the long dimension of this slot the thickness of the body of the control member 24 is progressively varied to form a camming surface 30 which decreases in height in the direction of the inner extremity of the control member 24.

Figure 6:
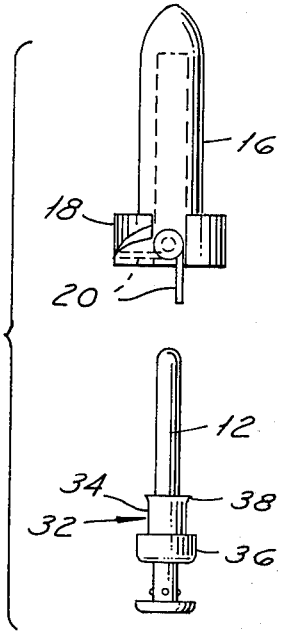
FIG. 6 is an enlarged side view of the spinner member and the upright post showing the two elements arranged in the order of their telescoping assembly.

Surrounding the post 12 in underlying relation to the group of discs 14 and resting on the top surface of the control member 24 is a ferrule or bushing type element generally indicated at 32 which is slidable up and down the post 12. As shown in FIG. 6, the ferrule is composed of two integrally connected sections, an upper sleeve section 34 which slidably fits the post 12 and extends through the axial holes of the discs received on the post and a lower cup-shaped section 36 of wider extent which overlaps the central area of the discs and is effective in raising the discs as a group when the ferrule is likewise raised by the camming action performed by the slanting surface 30 of the control member 24 when the latter is pushed inwardly of the device. The upper end of the ferrule may be outwardly flared as shown at 38 or otherwise appropriately shaped to serve as a seat for the lower end of the spinner knob 16 and in this manner bear the weight of the spinner member in place of the discs. Thus, there is no compressive pressure acting on the stack of discs thereby allowing them to freely rotate with respect to one another and the upright post 12. It is evident from this description that in its outermost position the control member 24 permits the ferrule and the stack of discs to assume their lower position where they are restrained from rotation by a frictional braking provision to be described hereinafter, but when the control member 24 is pushed inwardly its inclined camming surface 30 acts through the ferrule to lift the discs above the braking provision where the spinner knob 16 has unopposed freedom to rotate the discs.

If reference will be made to FIG. 2, it will be noted that the control member 24 is guided for straight-line motion between its extreme operating position by a pair of similar parallel ribs 40—40 which project upwardly from the base member 10 and may be formed integrally with the material thereof. These two ribs extend past the axis of the upright post 12 on opposite sides thereof. In the vicinity of the post 12, each rib 40 is outwardly laterally widened as shown in FIG. 2 to form two spaced apart similar arcuate segments 42—42. Centered on the upright member 12 and bridging the space between the arcuate segments 42—42 is a thin annularly-shaped plate member 44 of relatively rigid material which has several rounded bulges or protuberances 46 rising above its upper face which are evenly circularly spaced at a given radius around the upright post 12. The ring-shaped plate 44 is secured against movement in surrounding relation to the upright post 12 by the widened portions 42—42 of the ribs 40—40 and serves as an important element of the earlier mentioned braking provision for stopping rotation of the discs.

At the same radial distance from its axis each disc 14 is similarly provided with a number of rounded bulges or protuberances 48 which are registrable with those carried by the annular plate 44. However, as illustrated in FIG. 4 each disc carries a larger number of such bulges, in this instance twelve, than the plate 44 as evident in FIG. 2. Being of the same dimensions, it is apparent that the protuberances 48 on the discs 14 are nestable with one another and that the protuberances 46 on the stationary plate 44 are nestable with the protuberances 48 carried by the bottom disc of the stack. The result is that when the rotating stack of discs is lowered into engagement with the stationary annular plate 44, the bottom disc of the stack is retarded in its rotation by bumping over the protuberances 46 on the stationary plate and brought shortly to a stop when the protuberances of the bottom disc and the stationary plate fully nest with one another. Similarly, each higher disc in the stack is brought to a stop with the result that it would be an extremely rare occurrence if the discs in the stack did not assume a radial alignment at the conclusion of their rotation differing from that existing at the start of their rotation.

Figure 3:
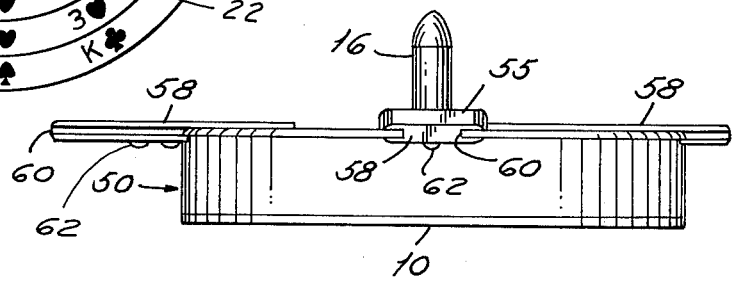
FIG. 3 is a side view of the embodiment illustrated in FIG. 1.

The description thus far has been devoted to the basic structure of the game device which renders it adaptable to various games utilizing spinning discs and the combinations of characters and symbols that these discs can assume. Usually there is a cover member associated with the basic structure and one such cover is generally indicated at 50 in FIGS. 1, 3 and 5. It comprises a circular side wall section 52 and a top section 54 which has a central opening through which the control knob 16 and the upright post 12 project as illustrated in FIG. 5. The radial dimension of the cover member 50 is such that the depending side wall 52 joins the peripheral edge of the circular base member 10 and may be adhesively bonded or otherwise secured thereto. The material of the cover through which the control knob 16 extends may be thickened as shown at 55 in FIG. 5 for strengthening purposes. Preferably, the base and cover members 10 and 50 may be formed of molded hardened plastic material. In fact, most if not all of the remaining parts of the game device may be made of such plastic material.

Figure 1:
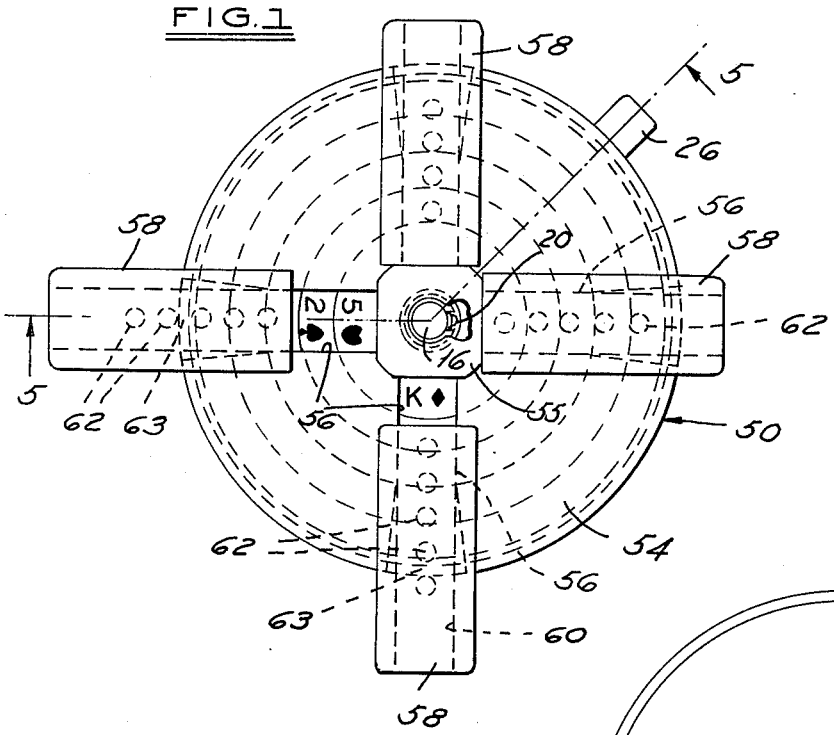
FIG. 1 is a top plan view of a game device embodying the invention showing four indicia concealable slots in the cover member.

The purpose of the cover member for the game device is not only to protect its operating parts from damage but also to partially or completely conceal the game symbols and characters from one or more of the players using the device. For example, the game device may be designed for two, three or four players who wish to play with a conventional deck of 52 playing cards in which a maximum deal of five cards to each player is made. An appropriate disc stack for such purpose is illustrated in FIGS. 1, 4 and 5. The cover is provided with four radial slots 56 in the top section equidistantly spaced around the axis thereof through which the symbols or characters on the margins of the discs are exposed in the manner shown in FIG. 1.

Mounted in each such slot 56 of the cover 50 is an opaque screen or shield 58 which is movable outwardly in the direction of the slot for progressively exposing the characters on the discs 14. This may be accomplished by making each shield 58 wider than its slot 56 and thicker than the cover member and grooving the side edges of the shield as shown at 60 in FIG. 3 to receive the side margins of the cover forming the slot. To releasably hold each shield in adjusted position in its slot, the underside of the shield is provided as shown in FIG. 5 with a row of rounded bulges or bumps 62 which successively ride over the edge of the vertical wall section 52 of the cover where the outer end of each slot terminates. The apexes of the bumps 62 are equidistantly spaced apart a distance equivalent to the character spaces of the discs so that each shield may be releasably held in position in the slot after exposure of each successive character on the discs. In doing so, the upper edge of the vertical wall section 52 at the outer end of each slot either interfits between adjacent pairs of the bumps as shown in dotted outline at 63 in FIG. 1 or abuts the sides of the outermost bumps of the row at the beginning or ending of this positioning movement of each shield.

Figure 7:
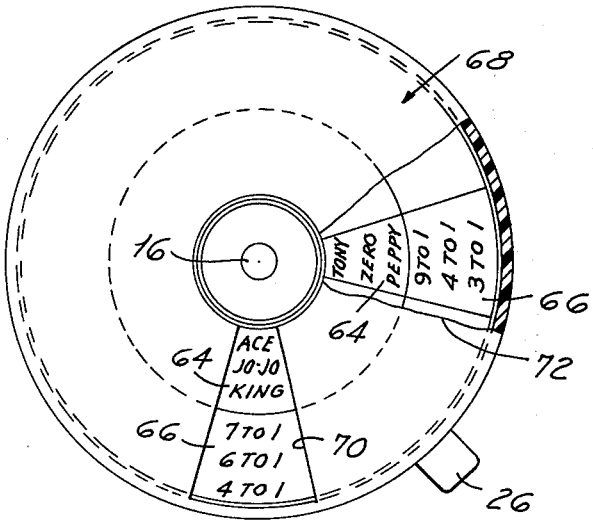
FIG. 7 is a top plane view of a modified form of the invention where the cover member employs a single slot to expose the radially aligned indicia therebelow, the cover member being broken away elsewhere to further show the nature and extent of the indicia for the particular game for which the indicia is designed.

FIG. 7 illustrates a different form of cover member associated with a different form of a disc assembly. Instead of five discs 14 in the precedingly described embodiment of the invention, the game device of FIG. 7 employs two discs 64 and 66, one of which may list the names of horses encountered in horse racing arranged circularly therearound and the other disc showing various odds for winning, place and show. The cover member 68 in the embodiment illustrated in FIG. 7 contains a single radial slot 70 which exposes only one combination of horses names and betting odds after each rotation by the knob 16. The cover member 68 of FIG. 7 has been broken away at 72 to show that the discs continue with similar names and odds as those exposed in slot 70, but normally for this type of game device only one slot is employed.

Games based on baseball and football may be played with the use of this form of spinner device. For example, a single disc may be used in the device bearing notations on radial segments for playing the game of baseball which are individually exposed to view through the slot 70 when the disc has stopped rotating. The radial segments would bear such notations as balls, strikes, various base hits and resulting advancements of runners on base, etc. For the game of football, similar radial segments on the disc would bear various types of plays and resulting outcomes. In order that the players may select the type of play in football the disc is divided into concentric circular areas representing a different type of play, and the marginal portion of the cover 68 extending along the slot 70 would bear legends signifying such plays and registering with the circular areas on the discs to which they apply. In this manner each player can select a football play in advance of rotating the disc, and the disc when spun and stopped in response to the call of the play will furnish the results of such play through the slotted opening. For other games the cover member and one or more discs can be similarly laid out to provide each player with a selection of plays the results of which are determined by the spin of the disc.

Figure 8:
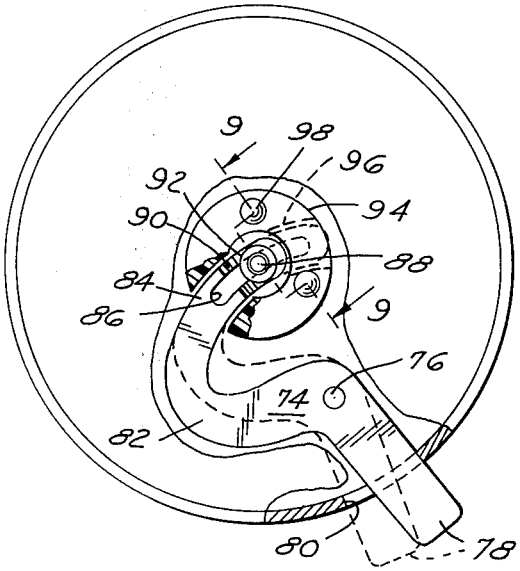
FIG. 8 is a fragmentary view a modified form of disc elevating and lowering mechanism.
Figure 9:
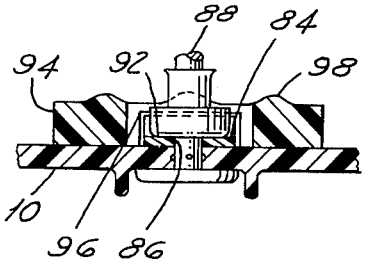
FIG. 9 is a detail section view taken along line 9—9 of FIG. 8.

A second embodiment of the invention is illustrated in FIGS. 8 and 9 which instead of the push-pull motion of the control member 24 of the previously described embodiment for raising and lowering the discs, this action is performed by the rocking or swinging motion of a control arm or member 74 which is pivotally mounted for swinging motion about an axis represented by the pivot pin 76. The outer end 78 of the control arm 74 projects through a side opening 80 in the cover which is substantially wider than the arm to allow its swinging motion as shown by the dotted and full lines of the arm in FIG. 8. By virtue of the bend 82 in the control arm 74 its opposite or inner end 84 moves in a slightly arcuate path at the point of intersection with the axis about which the discs rotate. This enables the inner end 84 of the control arm to be constructed like the inner end of the control member 24 with a slot 86 through which the post 88 extends which serves as the journal mount for the discs. As in the case of the first embodiment the thickness of the control arm 74 in the region of the slot 86 is progressively thinned as shown at 90 to form a camming surface for raising and lowering the group of discs. In the full line position of the arm 74, the slanting surface 90 is retracted to bring the thin end of the member under the disc supporting ferrule 92 thus enabling the ferrule and the disc to assume their lower braked position in the device. As the arm 74 is swung to its dotted position in FIG. 8, the camming surface 90 progressively lifts the ferrule 92 and the disc group into driving position with respect to the spinner knob associated with this embodiment of the invention which may be like the knob 16 of the earlier described embodiment.

The slotted inner end 84 of control arm 74 is movable along a slightly arcuate path as previously mentioned which may be centered as shown in FIG. 8 on the axis of the pivot pin 76. A platform 94 sits astride the inner arcuate end 84 of the arm 74 and is shaped internally with a similarly curved channel 96 for accommodating the movement of the end section 84 of the arm as shown in FIGS. 8 and 9. The platform in this modification is preferably a molded plastic body having a circular upper face upon which three rounded bulges or protuberances 98 have been molded integrally with the body. The three bulges are equidistantly spaced apart from one another around the axis about which the discs rotate and function as in the case of the bulges 46 of the previously described embodiment to brake the discs shortly to a halt. It is understood that the discs are similarly formed with rounded bulges which register with one another and with the bulges 98 and which in the stopped position are nested with one another and with the bulges 98. The plastic material chosen for the platform 94 may have a lubricous property to increase the slipperiness of the bulges to provide a greater number of revolutions of the discs before they are halted.

A few words may be said about the layout of the characters on the discs 14 in FIG. 4. As earlier mentioned herein the characters are intended to represent a conventional deck of 52 cards, but if a careful count is made of the card characters illustrated in FIG. 4 it will be found that there are 60 such characters shown. Each disc 14 bears twelve characters representing twelve cards and five such discs total a representation of 60 cards. This is done in order to have five characters show in each of the four radial slots 56 in the cover member at the end of every rotation of the disc stack. This is accomplished by duplicating a few of the minor valued cards and so locating them on their respective discs that only one such duplicate card can be exposed in the four slots 96 in any stopped position of the discs. In the illustrated arrangement, the three of diamonds and the four of clubs are carried twice on the smallest disc of the stack, the five of spades is repeated twice on the largest disc, the six of clubs and the seven of hearts are twice shown on the middle sized disc of the stack, the eight of hearts on the next to the largest disc, and the nine of diamonds and the two of spades are repeated twice on the next to the smallest disc. Moreover, each duplicate pair of card designations are so distributed on their respective discs that only one of the two will be exposed in any one of the four radial slots 56 of the cover member. This is accomplished in every instance by circumferentially spacing such duplicate card designations at angles other than 90° or multiples thereof. Accordingly, when each disc is in a rest position determined by the nesting of the bulges 46 and 48, only one such duplication of a card will appear in the quarterly spaced windows or slots 56 of the cover assembly.

In conclusion, it is evident that this invention has provided a spinning game device which avoids a compound motion of both spinning and axially moving the control knob for imparting rotation to the discs and of subjecting the disc members to resiliently imposed compression during their rotation such as by the use of springs acting on one or both ends of the disc stack. It is also further evident that this invention provides an important advantage in the manufacture of game devices of this character, i.e., the design and arrangement of the parts which enable the same base structure of the device including the disc spinning and stoppage provisions to be used for a plurality of different games, leaving only the shape of the cover member and the game symbols on the discs to be varied appropriately for different games. Other features and advantages of the invention are evident from the embodiments thereof which are illustrated and described herein.

While particular embodiments of the invention have been illustrated and discussed, it will be understood, of course, that it is not desired that the invention be limited thereto since modifications may be made. It is therefore contemplated by the appended claims to cover any such modifications as fall within the true spirit and scope of the invention.

What is claimed is:

1. A game apparatus including, in combination:

an upright post;

a plurality of discs mounted on said post for rotation thereabout independently of one another and for bodily axial movement therealong;

a control member means movable between first and second positions and operable when moved from the first position to the second position to raise the discs on the post as a group to a higher level and when moved from the second position to the first position to cause the discs to descend on the post to a lower level;

a spinner member rotatably mounted upon the post above the discs, said spinner member having means providing a one-way driving connection with the discs and being operable upon rotary movement in one direction to impart rotation to the discs, said driving connection being operable to free the discs for individual rotation movement when the discs overrun the driving connection, and stop means engageable with the discs when the same have assumed their lower level to stop the rotation of the discs.

2. The game apparatus as set forth in claim 1 wherein the control member means has a camming surface which in its movement from the first position to the second position acts on the underside of the lowermost disc to raise the discs as a group to their higher level.

3. The game apparatus as set forth in claim 1 wherein the discs have apertures therein registrable with one another, and wherein the driving connection means of said spinner member has a driving element enterable into the apertures of the discs to impart rotation thereto when the spinner member is rotated in one direction but being capable of withdrawing from the apertures when the discs overrun the driving element.

4. The game apparatus as set forth in claim 1 wherein the control member means has a camming surface which in the movement of the control member means from the first position to the second position acts on the underside of the lowermost disc to raise the discs as a group to their higher level and which in the movement of the control member means from the second position to the first position allows the discs to descend as a group to the lower level.

5. The game apparatus as set forth in claim 1 wherein the stop means includes similarly formed bulges on the discs which are registrable with one another and ultimately nest with one another as the discs are freed to slow their rotation to a halt.

6. The game apparatus as set forth in claim 5 wherein the stop means further includes a non-rotatable member having protrusions registrable with the bulges on the lowermost disc when the discs descend to their lower level position.

7. A game apparatus including, in combination:

a base support;

a vertical post carried by the base support and rising approximately centrally thereof;

a stack of discs of progressively larger diameter from the upper end to the lower end thereof and mounted on said post within said enclosed space for independent rotation thereabout and for axial movement up and down the post;

a cover member stationarily mounted on the base support and forming a space enclosing the stack of discs, said cover member having an aperture therethrough aligning with the post and further having at least one slot radially disposed with respect to the discs through which the peripheral portions of the discs are exposed;

control means for raising and lowering the discs as a group on the post including a control member movable from a first position to a second position and means effective when the control member is so moved to raise the discs on the post to a higher level is said space and effective when the control member is moved from the second position to the first position to cause the discs to descend on the post to a lower level in said space;

a spinner member journaled on the upper end of the post and extending to a height above the cover member for manual manipulation, said spinner member having means provding a one-way driving connection with the stack of discs when the latter assume their higher level in the enclosed space and being effective to drivingly rotate the discs in one direction around the post but being ineffective to retard or stop the rotation of the discs when the discs overrun the driving connection; and means for successively bringing the rotation of the discs to a halt when they have assumed their lower level in the enclosed space, said means including buldged out protuberances on the discs which are nestable with one another when the discs are stationary but which when rotated allow the discs to separate from one another and assume different rotating speeds, and said means further including a stationary member on the base support having similar protuberances which partially enter and leave the protuberances of the largest diameter disc of the stack as the latter rotates thereby until this disc and in a similar manner all remaining discs in the stack are brought to a rest.

8. The game apparatus as set forth in claim 7 wherein the peripheral margins of the discs of the stack are divided into sectors circularly spaced around the discs and which are singularly exposed to view through any radial slot of the cover member while the remaining sectors are concealed from view by the cover member, and wherein the bulged out protuberances are so spatially located on the discs and on the stationary member that the discs are brought to rest with a sector of each disc registration with a radial slot in the cover member.

9. The game apparatus as set forth in claim 8 wherein each said radial slot in the cover member includes an opaque shield member having means for movement toward and away from the axis of the post for successively exposing to view those sectors on the peripheral margins of the discs which are in registration with said radial slot.

10. The game apparatus as set forth in claim 9 wherein means is provided for releasably detaining the shield member in its path of movement after the exposure of the sector on the peripheral margin of each disc in the stack of discs.

11. The game apparatus as set forth in claim 10 wherein means is provided for guiding the control member for rectilinear motion when moving from said first position to said second position and return.

12. The game apparatus as set forth in claim 10 wherein means is provided for mounting the control member for pivotal motion when moving from said first position to said second position and return.

13. In a game apparatus, including in combination;

a stack of disc-like members independently rotatable about a common substantially vertical axis and independently axially movable therealong;

means effective to raise the stack of disc members from a first position on the axis to a second higher position on the axis and further effective to allow the disc members while rotating to fall toward the first position;

means for imparting a common speed of rotation to the disc members when the same are raised to the second position on the axis;

means for individually retarding the rotation of the disc members when they approach and assume the first position on the axis, said means including similar bulged out protuberances which are correspondingly positioned on each of the disc members and which are fully nestable with one another when the disc members are at rest or rotating at the same speed, and said retarding means further including a stationary member in the first position on the axis against which the first of the falling disc members abuts, said stationary member likewise having one or more similarly shaped and radially positioned protuberances which are fully nestable with the hollow interiors of the protuberances of the first falling disc only when the latter is in stationary abutment therewith, but which because of the rotative condition of this first disc member and all succeeding disc members these members are all successively frictionally slowed by the bumping reaction resulting from the partial nesting of the protuberances on each member with the hollow interiors of the bulged out protuberances of the next adjacent member until all have been brought to a fully nested non-rotative condition.

14. The game apparatus as set forth in claim 13 wherein the disc members are each divided into sectors around the vertical axis in which different indicia relating to the game for which the disc members are designed are located, and wherein the bulged out protuberances are so positioned on their respective members that they act to bring the rotative motion of the disc members to a halt with the individual sectors of the disc members in radial alignment with one another.

15. The game apparatus as set forth in claim 14 wherein there is provided a cover member substantially enclosing the disc members and having one or more slots radiating from said vertical axis in which the peripheral margins of the disc members are exposed, said one or more slots being so located with reference to the bulged out protuberances as to align with the sectors of the disc members when their rotative motions are brought to a halt by the protuberances.

* * * * *